US007025097B1

(12) United States Patent
Hayes

(10) Patent No.: US 7,025,097 B1
(45) Date of Patent: Apr. 11, 2006

(54) METHOD OF FILLING BAGS

(75) Inventor: Glenn Hayes, De Pere, WI (US)

(73) Assignee: Campbell Wrapper Corporation, Depere, WI (US)

( * ) Notice: Subject to any disclaimer, the term of this patent is extended or adjusted under 35 U.S.C. 154(b) by 0 days.

(21) Appl. No.: 10/976,658

(22) Filed: Oct. 29, 2004

(51) Int. Cl.
*B65B 1/04* (2006.01)

(52) U.S. Cl. ..... 141/10; 141/114; 141/313; 141/314; 53/469; 53/570

(58) Field of Classification Search ..... 141/10, 141/114, 166–176, 313–316; 53/468–473, 53/284.7, 570
See application file for complete search history.

(56) References Cited

U.S. PATENT DOCUMENTS 4,432,186 A * 2/1984 McGregor ..... 53/69
6,776,197 B1 * 8/2004 DeCrane ..... 141/10

OTHER PUBLICATIONS

Product Brochure, Model S Bagger, 2 pages, 1985.
Product Brochure, comparing S-Series and HS-Series Bag Hangers, 2 pages, 2005.

* cited by examiner

*Primary Examiner*—Timothy L. Maust
(74) *Attorney, Agent, or Firm*—Wood, Phillips, Katz, Clark & Mortimer

(57) ABSTRACT

A method of operating a filling apparatus for filling bags includes providing a fill hopper having a discharge opening, and positioning each bag to be filled beneath the discharge opening. To promote efficient operation, each bag is positioned in a stand-by position after one of a pair of bag openers, which open each bag, has been moved a sufficient distance from the previous bag to provide clearance in the stand-by position. The cycle time for positioning, opening, and filling each bag is desirably decreased for promoting efficient operation of the filling apparatus.

8 Claims, 4 Drawing Sheets

METHOD OF FILLING BAGS

TECHNICAL FIELD

The present invention relates generally to a method of operating automated equipment for filling bags with granular material, and more particularly to a method of filling bags which facilitates efficient operation of such equipment by positioning the next one of a plurality of bags in a make-ready or stand-by position, after one of a pair of bag openers has been retracted through the stand-by position.

BACKGROUND OF THE INVENTION

A variety of granulated or otherwise free-flow particulate products are typically packaged and sold in flexible bags, including products such as bird seed, fertilizer, pet food, and the like. To promote efficient packaging of such products, automated weighing and dispensing machines are typically employed, with such machines being operated by positioning one of the bags in the dispensing machine, while the bag is held in a generally vertical orientation. Thereafter, the bag is opened by separation of the front and rear walls thereof, and free-flow product dispensed into the bag. The bag is thereafter released from the dispensing machine for subsequent movement to a suitable sealing apparatus, and the filling cycle repeated.

As will be recognized by those familiar with the art, any reduction in the time required for effecting positioning, opening, and filling of each of the flexible bags can greatly enhance the efficiency with which such equipment is operated. The present invention is directed to a method of filling bags with automated filling equipment which has been found to very desirably increase the efficiency with which such equipment can be operated by shortening the cycle during which each bag is positioned in the equipment and subsequently filled.

SUMMARY OF THE INVENTION

A method of successively filling bags with automated equipment in accordance with the present invention desirably effects significant savings in the filling cycle for each of the bags by carefully coordinating the placement of the bag to be filled with the filling and release of a previous bag. In particular, during or after filling of each bag, the bag is released, and one of a pair of bag openers is retracted to provide clearance in a stand-by position. After this movement, a next one of the bags to be filled is moved into and positioned at the stand-by position, thus facilitating initiation of the filling of the next bag.

In accordance with the present method, a fill hopper is provided which has a discharge opening that generally defines a filling region beneath the hopper. A pair of bag openers are provided which are positioned generally beneath the fill hopper on respective opposite sides of the discharge opening. One of the bag openers is a so-called long-stroke opener, in view of its longer range of movement beneath the discharge opening of the fill hopper, and with the other one of the openers being a so-called short-stroke opener, positioned for movement generally on one side of the discharge opening.

In accordance with the present method, one of the bags to be filled is provided, with the bag having front and rear walls which are separable for opening the bag. A vacuum-operated articulable picker head is preferably employed for handling each bag.

The present invention next entails positioning one of the bags in closely spaced relationship to the filling region in a make-ready or stand-by position. In accordance with the preferred embodiment, the bag is maintained in a generally vertical orientation during this positioning step.

After the bag to be filled has been positioned in the stand-by position, the bag is advanced into the filling region, and opened by moving the front and rear walls thereof apart for filling, with movement of the long-stroke and short-stroke openers away from each other effecting opening of each bag. In the preferred form, suction is applied to the front and rear walls of each bag by the bag openers during the opening step. During this action, one of the bag openers, i.e., the short-stroke opener, can deflect the top portion of the bag as that opener moves through the stand-by position to engage the bag, urging the bag toward the filling region.

After filling, each bag moves away from the fill hopper. In accordance with the preferred practice, this is effected by releasing the suction applied to the front and rear walls of each bag by the openers.

In accordance with the present method, another one of the bags to be filled is moved into and positioned at the stand-by position when the short-stroke opener has been retracted through the stand-by position, thus providing clearance for the next bag. This is a significant feature of the present invention, in that it desirably acts to significantly shorten the filling cycle for each bag, since the next bag to be filled is positioned in the stand-by position very shortly after the previous bag has been released by the short-stroke opener, and this opener retracted through the stand-by position.

Other features of the present method facilitate efficient operation of the filling apparatus. Preferably, one of the bag openers, preferably the short-stroke opener, is moved away from the other opener during the bag-releasing step, to thereby permit movement of the next one of the bags into the stand-by position. The long-stroke opener may also be retracted. Subsequently, the short stroke one of the openers is moved toward the other one of the openers, after the positioning step, and before the opening step. As noted, in accordance with the presently preferred practice, this one of the openers moves through the stand-by position and acts to deflect the top of the bag, urging it toward the filling region prior to release of the bag by the picker head. The other one of the openers, i.e., the long-stroke opener in the illustrated embodiment, moves beneath the discharge opening to engage the bag, and thereafter is retracted and moved back beneath the discharge opening, thus opening the bag beneath the discharge opening.

To further promote efficient operation of the filling apparatus, the present method contemplates that the next one of the bags to be filled is moved toward the stand-by position during filling of the previous one of the bags.

Other features and advantages of the present invention will become readily apparent from the following detailed description, the accompanying drawings, and the appended claims.

DETAILED DESCRIPTION

Figure 1:
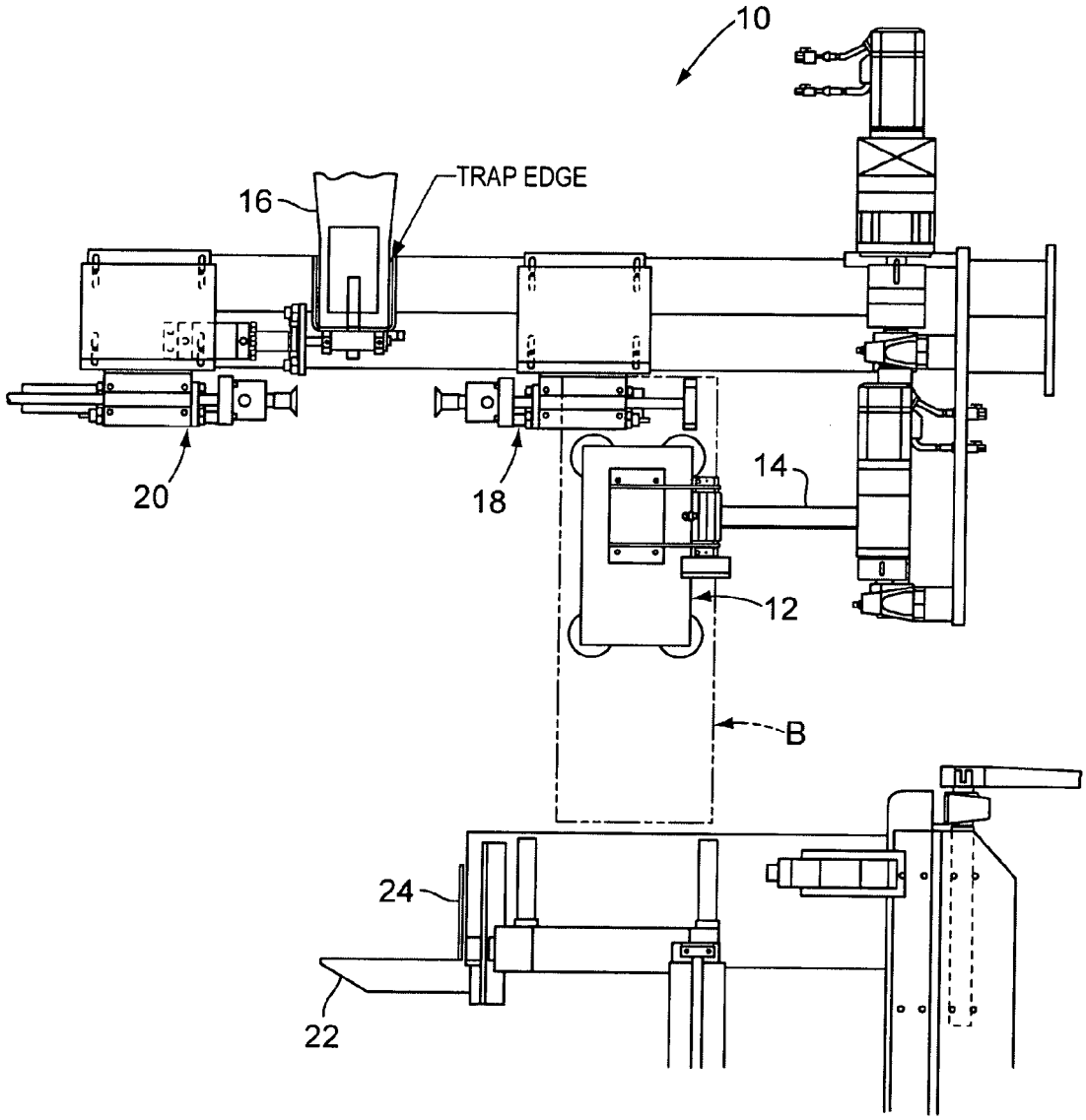
FIG. 1 is a diagrammatic, side elevational view of a filling apparatus for practicing the method of the present invention.

While the present invention is susceptible of embodiment in various forms, there is shown in the drawings, and will hereinafter be described, a presently preferred embodiment of the invention, with the understanding that the present disclosure is to be considered as an exemplification of the invention, and is not intended to limit the invention to the specific embodiment illustrated.

With reference first to FIG. 1, therein is diagrammatically illustrated a filling apparatus 10 which is operable in accordance with the present invention for effecting successive filling of bags B. In the illustrated embodiment, wrapping apparatus 10 is shown as a Campbell Wrapper Corporation Model HS Simples Bagger. As will be recognized by those familiar with the art, the present method can be practiced with other similar filling apparatus.

Bags to be filled are presented to the filling apparatus 10 by an articulable picker head 12 which removes each bag, by application of suction, from an associated bag magazine. In the preferred form, a plurality of bags are retained in the associated magazine in a generally vertical orientation, with each bag to be filled presented to the filling apparatus 10 while maintained in a generally vertical orientation.

The picker head 12 is supported by a pivotal picker arm 14, which is pivotal by a suitable servo drive through an arcuate range of motion for moving the picker head between the associated bag magazine and the filling apparatus 10. At the same time, the picker head is rotatable with respect to a free end of the picker arm by another suitable servo motor drive, thus providing the desired articulable movement of the picker head. During such articulable movement, the face of the picker head is preferably maintained in a generally vertical orientation, thereby maintaining each bag B in the preferred generally vertical orientation as it is moved from the associated bag magazine into the filling apparatus 10.

The filling apparatus 10 includes a fill hopper 16 which has a discharge opening through which the contents of the hopper are discharged, by gravity, into each bag to be filled. Fill hopper 16 is typically but one portion of the overall filling apparatus, which typically further includes suitable dispensing and weighing mechanisms whereby a predetermined quantity (by weight) of granular or otherwise free-flow material is repeatedly placed in the fill hopper 16, for subsequent dispensing into a respective one of the bags B. To this end, the fill hopper 16 typically includes a pair of cooperating trap doors or gates, with the discharge opening of the fill hopper, and associated trap doors, generally defining a filling region beneath the fill hopper. This filling region is positioned generally beneath the trap doors of the fill hopper, with an edge thereof generally corresponding to the labeled "trap edge" of the drawings. The "trap edge" generally indicates the one of the sides of the trap doors of the fill hopper which are intended to fit within the open mouth of one of the bags B when it is positioned for filling beneath the hopper.

To effect filling, each bag B is positioned in the filling region beneath the fill hopper 16, with the front and rear walls of the bag separated so that the mouth of the open bag can receive the trap doors of the fill hopper, as the doors typically pivot downwardly to form a chute-like structure extending into the open mouth of the bag to be filled.

In order to effect opening of each bag B as it is positioned generally beneath the fill hopper 16, the filling apparatus 10 includes a pair of bag openers positioned generally beneath the fill hopper. A first bag opener 18, designated the so-called short-stroke opener, is positioned generally beneath the fill hopper, and is movable through a range of motion or stroke generally at one side of the filling region defined by the discharge opening of the fill hopper. In contrast, the other one of the bag openers, designated 20, and referred to as the long-stroke opener, is positioned generally beneath the fill hopper, and has a range of motion or stroke which extends generally through the filling region defined by the discharge opening of the fill hopper. In the preferred form, each of the openers 18, 20 includes suitable selectively operable suction cups, whereby suction can be applied to the front and rear walls of each bag B as each bag is opened for filling.

During filling, each bag is held in position beneath the fill hopper by the bag openers 18, 20, with the edges of the openers respectively positioned at opposite sides of the filling region, i.e., in substantial alignment with the trap edge. After filling, each bag is released so that it moves away, by gravity, from the fill hopper 16. In the illustrated embodiment, this releasing action is effected by releasing the suction that is applied to the front and rear walls of the bag by the openers 18, 20, with each filled bag thereafter received on a bag push-off grate 22 positioned generally beneath the fill hopper 16. Thereafter, each filled bag is moved off of the grate 22 by an associated push-off plate 24, thereby transferring each filled bag to a suitable take-away conveyor for subsequent sealing of the top end of the bag.

The method of operating the filling apparatus 10 in accordance with the present invention will now be described. Heretofore, this type of filling apparatus has typically been operated by positioning each bag to be filled generally along the centerline of the fill hopper discharge opening, thereby requiring that each bag be completely clear of the fill hopper before a next one of the bags is presented for filling. As will be appreciated, the reduction in filling cycle time achieved by the practice of the present method is effected by placing each bag to be filled in a "make ready" or stand-by position as soon as clearance is provided in the stand-by position by retraction of short-stroke opener 18 therethrough. In the illustrated embodiment, the openers 18, 20 release the bag after filling, and are moved apart, while the filled bag is moved away, by gravity, from the discharge opening. Further efficiency is achieved by moving the next one of the bags toward the stand-by position of the filling apparatus during filling of the previous one of the bags.

Figure 2:
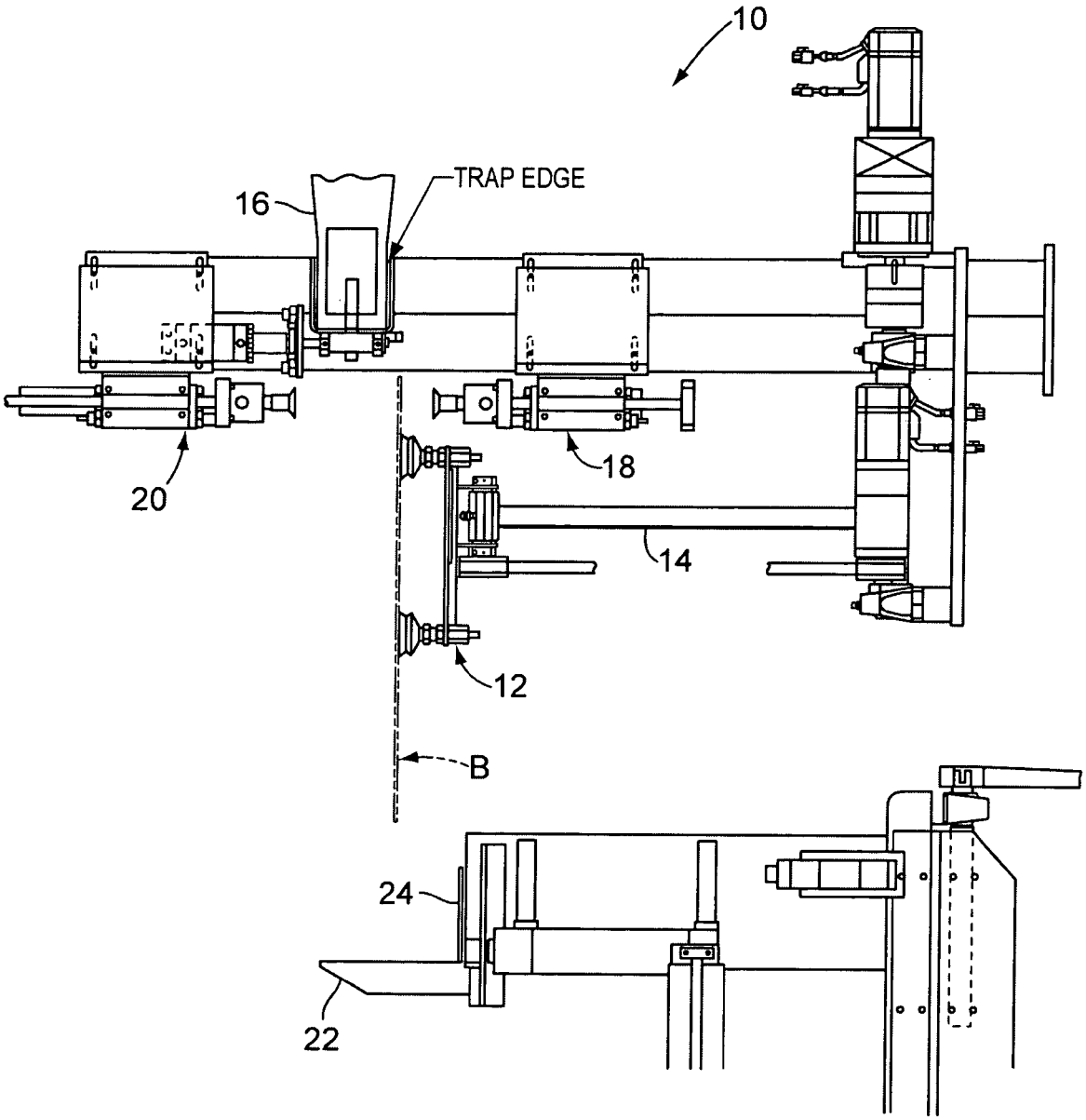
FIG. 2 is a diagrammatic view similar to FIG. 1, showing a bag to be filled being moved into a stand-by position, prior to filling.

With particular reference to FIG. 1, picker head 12 has withdrawn one of the bags B to be filled from the associated bag magazine, and by articulating movement, is positioning the bag in the stand-by position relative to fill hopper 16. FIG. 2 illustrates the bag B in the stand-by position. In presently preferred practice, the stand-by position is in closely spaced relationship to the filling region, with sufficient spacing as to avoid interference with a bag being filled or moving away from the fill hopper, while still permitting a bag in the stand-by position to be rapidly moved into position for filling beneath the hopper. As will be observed, during movement of the bag into the stand-by position, short-stroke opener 18 is in its fully retracted position, as is long-stroke opener 20. As will be appreciated, retraction of short-stroke opener 18 through the stand-by position provides the necessary clearance in the position to permit the next bag to be filled to be moved into the stand-by position.

In order to permit movement of the next bag B to be filled into the stand-by position, movement of the openers 18 and 20 away from each other is effected. In the illustrated embodiment, after the openers have been operated to release the previously-filled bag, the previously-filled bag moves, by gravity, downwardly onto push-off grate 22. In the preferred practice of the present invention, the bag B which is to be filled next is moved toward the illustrated stand-by position as the previous bag is being filled.

Figure 3:
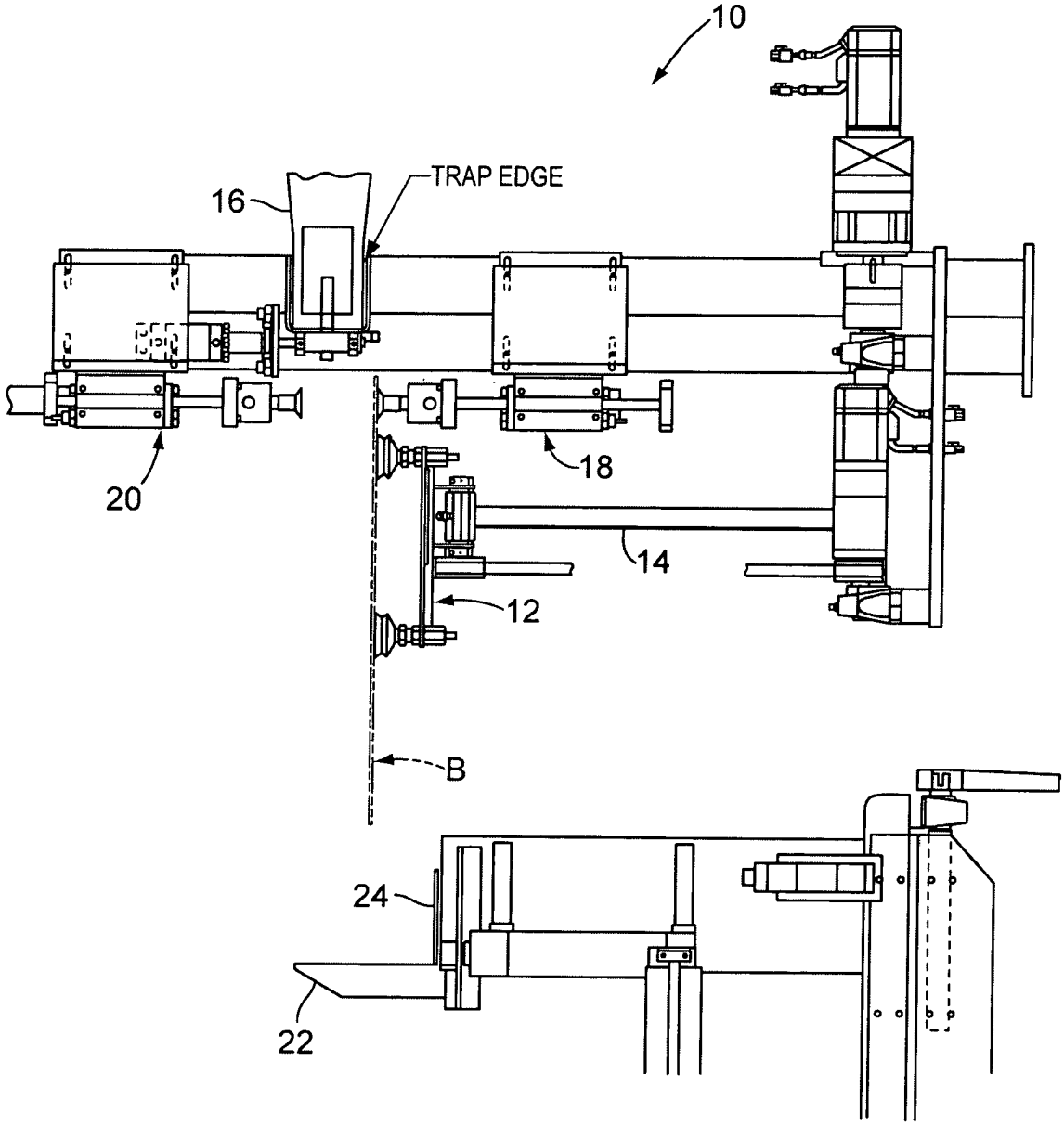
FIG. 3 is a further diagrammatic view illustrating a bag to be filled in the stand-by position, with the bag engaged by one of a pair of openers of the filling apparatus.

FIG. 3 illustrates bag B in the stand-by position with the openers 18, 20 having been previously retracted. Short-stroke opener 18 has been fully extended, with the opener engaging and applying suction to one of the front and rear walls of the bag B. The top of the bag B is deflected toward the filling region as short-stroke opener 18 is fully extended to its position at the filling region.

Figure 4:
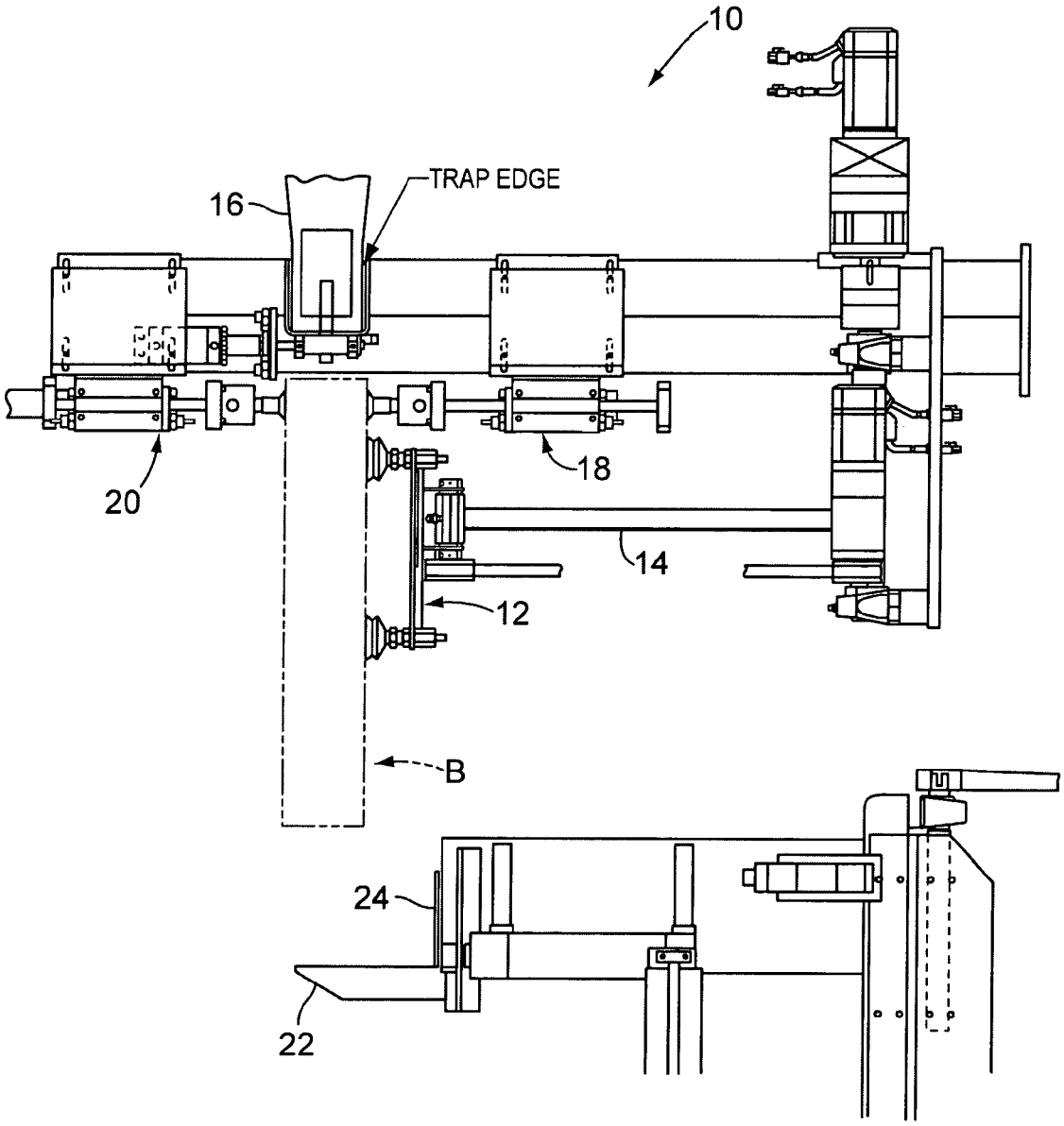
FIG. 4 is a further diagrammatic view illustrating a bag to be filled after the openers have been moved away from each other, and the bag opened for filling.

FIG. 4 illustrates the bag B in position to be filled, after long-stroke opener 20 has been extended through the filling region to engage the bag, and then moved away from opener 18 by movement of the opener 20 beneath the discharge opening. Filling is now initiated by operation of the trap doors of the fill hopper, with the bag, and its contents, supported by the suction applied by openers 18, 20.

After the desired predetermined quantity of granular or other free-flow material has been placed in the opened bag B from the fill hopper, the filled bag is released by releasing the suction applied to the front and rear walls thereof by the openers 18, 20. The filled bag then moves away from the fill hopper, by gravity, and toward the push-off grate 22. For some applications, a bag being filled can be supported by an associated movable shelf or the like, in which case the openers 18, 20 can be disengaged from the bag prior to the completion of filling.

During filling, the next bag to be filled is retained by picker head 12, generally outside the path of movement of the previously-filled bag B. After the filled bag B is released from openers 18, 20, short-stroke opener 18 is retracted to the position illustrated in FIGS. 1 and 2, thus providing clearance in the stand-by position, and permitting movement of the next bag into the stand-by position by picker head 12. Long-stroke opener 20 may also be retracted. Operating efficiency is promoted by moving the next bag into the stand-by position as short-stroke opener 18 has been disengaged from the bag and retracted through the stand-by position, which in the illustrated embodiment, occurs as the previously-filled bag is moving by gravity onto the push-off grate 22. Further efficiency is achieved by moving the next bag toward the stand-by position during filling of the previous bag.

After the next bag to be filled is positioned by picker head 12 in the stand-by position, openers 18, 20 are operated and extended to engage and apply suction to the front and rear walls of the bag. Ordinarily, the bag is engaged by short-stroke opener 18 prior to engagement by long-stroke opener 20. Picker head 12 is moved back toward the associated bag magazine, and the filling cycle repeated.

To promote efficient transfer of each bag B from the picker head 12 to the openers 18, 20, it is presently preferred that the suction applied by each of the openers 18, 20 to each bag B be applied prior to release of each bag from the picker head 12. Thus, each bag B is retained on the picker head prior to application of suction to the front and rear walls of each bag by the openers 18, 20. This assures the desired transfer of each bag from the picker head to the openers 18, 20 while each bag is in the stand-by position, prior to opening and filling.

From the foregoing, it will be observed that numerous modifications and variations can be effected without departing from the true spirit and scope of the novel concept of the present invention. It is to be understood that no limitation with respect to the specific method disclosed herein is intended or should be inferred. The disclosure is intended to cover, by the appended claims, all such modifications as fall within the scope of the claims.

What is claimed is:

1. A method of filling bags, comprising the steps of:

providing a fill hopper having a discharge opening defining a filling region;

providing one of said bags, said bag having front and rear walls;

providing a pair of bag openers which respectively engage said front and rear walls;

positioning said one of said bags in a stand-by position in closely spaced relationship to said filling region;

opening said bag by respectively engaging said front and rear walls with said pair of openers, and moving the front and rear walls thereof apart by moving said bag openers away from each other, said opening step including moving one of said openers through said stand-by position, disengaging at least said one opener from said bag to provide clearance in said stand-by position; and moving another one of said bags into said stand-by position, wherein said openers comprise a long-stroke bag opener and a short-stroke bag opener generally beneath said fill hopper for moving the front and rear walls of each said bag apart after each of said bags is moved into said stand-by position, by movement of said openers away from each other, including applying suction to the front and rear walls of each said bag with said openers during said opening step.

2. A method of filling bags in accordance with claim 1, including:

maintaining each said bag in a generally vertical orientation during said positioning step.

3. A method of filling bags, comprising the steps of:

providing a fill hopper having a discharge opening that defines a filling region;

providing a pair of bag openers positioned generally beneath said fill hopper;

providing one of said bags from a plurality of said bags, each said bag having front and rear walls;

positioning said one of said bags in closely spaced relationship to said filling region in a stand-by position;

opening said one of said bags by respectively engaging said front and rear walls with said pair of openers, and moving the front and rear walls thereof apart by moving said bag openers away from each other, and filling said one of said bags;

releasing said one of said bags from said openers; and moving a next one of said bags into said stand-by position after one of said openers is moved to provide clearance in said stand-by position, including applying suction to the front and rear walls of each said bag with said openers during said opening step, and releasing suction from the front and rear walls of each said bag during said releasing step.

4. A method of filling bags in accordance with claim 3, wherein:

said one of said bags moves, by gravity, away from said discharge opening by said releasing step.

5. A method of filling bags in accordance with claim 3, including:

moving said one of said openers toward the other one of said openers after said positioning step, and before said opening step.

6. A method of filling bags in accordance with claim 3, including:

moving one of said bag openers beneath said discharge opening during said opening step.

7. A method of filling bags in accordance with claim 3, including:

moving said next one of said bags toward said stand-by position during said filling of said one of said bags.

8. A method of filling bags in accordance with claim 3, including:

providing a picker head for moving each said bag toward and into said stand-by position, said method including retaining each said bag on said picker head until said step of applying suction to the front and rear walls of each said bag.

* * * * *